US008973645B1

(12) United States Patent
Cannova

(10) Patent No.: US 8,973,645 B1
(45) Date of Patent: Mar. 10, 2015

(54) PORTABLE WIND-RESISTANT TRAFFIC SCREEN AND RELATED METHOD

(76) Inventor: Carl S. Cannova, University Park, FL (US)

( * ) Notice: Subject to any disclaimer, the term of this patent is extended or adjusted under 35 U.S.C. 154(b) by 200 days.

(21) Appl. No.: 13/532,158

(22) Filed: Jun. 25, 2012

Related U.S. Application Data

(63) Continuation-in-part of application No. 13/216,426, filed on Aug. 24, 2011, now abandoned.

(51) Int. Cl.
*A47G 5/00* (2006.01)

(52) U.S. Cl.
USPC ..... 160/351

(58) Field of Classification Search
CPC ..... E04B 2/7422; E04B 2002/7479
USPC ..... 160/351, 368.1; 248/172, 125.8, 529, 248/150; 40/600, 611.01, 607.02, 607.04, 40/611.06–611.08, 607.11; 454/170
See application file for complete search history.

(56) References Cited

U.S. PATENT DOCUMENTS

| | | | | | |
|---|---|---|---|---|---|
| 2,819,901 | A | * | 1/1958 | Mateja | 473/421 |
| 2,855,037 | A | * | 10/1958 | Stiffel | 160/135 |
| 3,003,729 | A | * | 10/1961 | Petrick | 248/171 |
| 3,309,049 | A | * | 3/1967 | Albee, Jr. | 248/171 |
| 4,119,301 | A | | 10/1978 | Payne | |
| 4,124,196 | A | | 11/1978 | Hipskind | |
| 4,606,394 | A | | 8/1986 | Bannister | |
| 4,770,086 | A | * | 9/1988 | Gabster | 454/170 |
| 4,792,258 | A | | 12/1988 | Goff | |
| 5,012,603 | A | * | 5/1991 | Elcock | 40/605 |
| 5,150,554 | A | * | 9/1992 | Quinlan et al. | 52/282.2 |
| 5,207,260 | A | | 5/1993 | Commesso | |
| 5,234,280 | A | * | 8/1993 | Cowan | 404/6 |
| 5,323,835 | A | * | 6/1994 | Bachmeier | 160/89 |
| 5,402,988 | A | * | 4/1995 | Eisele | 256/24 |
| 5,402,999 | A | * | 4/1995 | Keehn, Sr. | 473/472 |
| 5,429,404 | A | * | 7/1995 | King, Sr. | 296/79 |
| 5,680,893 | A | * | 10/1997 | Neer | 160/330 |
| 5,758,868 | A | | 6/1998 | Shea | |
| 5,875,597 | A | | 3/1999 | Gingrich et al. | |
| 6,070,640 | A | * | 6/2000 | Miyagawa et al. | 160/121.1 |
| 6,142,701 | A | * | 11/2000 | Falcon | 404/6 |
| 6,182,740 | B1 | * | 2/2001 | Pfaff | 160/351 |
| 6,530,338 | B2 | * | 3/2003 | Okumura et al. | 116/173 |
| 6,532,703 | B1 | * | 3/2003 | Barrens | 52/202 |
| 6,702,482 | B2 | * | 3/2004 | Sherwin | 396/428 |
| 6,807,999 | B1 | * | 10/2004 | Bowen et al. | 160/24 |
| 6,962,188 | B2 | * | 11/2005 | Coenraets | 160/180 |
| 6,969,185 | B1 | | 11/2005 | Adair | |
| D533,111 | S | * | 12/2006 | Taddia | D11/181 |
| 7,178,790 | B2 | | 2/2007 | de Lorenzo | |
| 7,217,061 | B2 | | 5/2007 | Stratton | |

(Continued)

*Primary Examiner* — Katherine Mitchell
*Assistant Examiner* — Johnnie A Shablack
(74) *Attorney, Agent, or Firm* — Allen, Dyer, Doppelt, Milbrath & Gilchrist

(57) ABSTRACT

A wind-resistant portable traffic screen assembly comprising a screen to visually occlude matter behind the screen for the purpose of preventing traffic jams and generally blocking accidents, crime scenes, and other distractions from public view. The traffic screen comprises a substantially vertical member for maintaining the screen and a removable fastener with the screen that removably attaches the screen to the vertical member upon exposure to sufficient wind pressure. The screen partially disengages from the vertical member for the purpose of reducing wind pressure exerted upon the entire assembly to reduce the chance that the assembly topples over due to windy conditions.

16 Claims, 8 Drawing Sheets

(56) References Cited

U.S. PATENT DOCUMENTS

| | | | | |
|---|---|---|---|---|
| 7,219,709 | B1 | 5/2007 | Williams | |
| 7,320,353 | B1 * | 1/2008 | Miller et al. | 160/89 |
| 7,377,490 | B1 | 5/2008 | Khosravian | |
| 7,600,554 | B1 * | 10/2009 | Wright et al. | 160/327 |
| 7,841,378 | B2 * | 11/2010 | Henning | 160/327 |
| 7,874,090 | B2 * | 1/2011 | Flagg | 40/605 |
| 7,946,066 | B2 * | 5/2011 | Wamsley | 40/657 |
| 7,974,004 | B2 * | 7/2011 | Maruyama | 359/443 |
| 8,066,051 | B2 * | 11/2011 | Whittemore | 160/368.1 |
| 8,091,605 | B1 * | 1/2012 | Melhart | 160/135 |
| 8,365,798 | B2 * | 2/2013 | Feldpausch et al. | 160/84.06 |
| 8,601,730 | B2 * | 12/2013 | Ceurvels | 40/610 |
| 8,613,153 | B2 * | 12/2013 | Ceurvels | 40/610 |
| 2002/0178998 | A1 * | 12/2002 | Okumura | 116/174 |
| 2005/0098770 | A1 | 5/2005 | Schell | |
| 2006/0011309 | A1 | 1/2006 | Vicari et al. | |
| 2006/0060310 | A1 * | 3/2006 | Haugen | 160/135 |
| 2006/0151123 | A1 | 7/2006 | Chandler et al. | |
| 2006/0213628 | A1 * | 9/2006 | McLoughlin et al. | 160/351 |
| 2007/0228349 | A1 | 10/2007 | Smith | |
| 2007/0235068 | A1 * | 10/2007 | Green | 135/114 |
| 2007/0235151 | A1 * | 10/2007 | Stull | 160/351 |
| 2007/0283625 | A1 * | 12/2007 | Morrissey et al. | 49/87.1 |
| 2008/0011435 | A1 * | 1/2008 | Wild et al. | 160/351 |
| 2008/0236768 | A1 | 10/2008 | Blair | |
| 2010/0059187 | A1 * | 3/2010 | Moore | 160/351 |
| 2010/0181544 | A1 * | 7/2010 | Wettern | 256/73 |
| 2010/0288450 | A1 * | 11/2010 | Bruck et al. | 160/238 |
| 2011/0297339 | A1 * | 12/2011 | Yi et al. | 160/370.21 |
| 2013/0340955 | A1 * | 12/2013 | Parker, III | 160/351 |

* cited by examiner

PORTABLE WIND-RESISTANT TRAFFIC SCREEN AND RELATED METHOD

CROSS-REFERENCE TO RELATED APPLICATION

This is a Continuation-in-Part Application of U.S. patent application Ser. No. 13/216,426 filed on Aug. 24, 2011 entitled "Portable Height Adjustable Barrier for Screening Off the Source of Traffic Congestion," the contents of which are incorporated by reference herein.

FIELD OF THE INVENTION

The present invention is generally directed to a portable and wind-resistant barrier for visually screening areas from motorists to reduce "gawking" and resultant traffic congestion and related method.

BACKGROUND

Vehicular traffic congestion often occurs as road use increases, such as during peak travel times. Such congestion is characterized by slower speeds, longer travel times, and often a sense of driver frustration. Causes of traffic congestion, or "traffic jams" may include, among other things, roadwork, detours, increased traffic volume such as during "rush hour", and vehicle accidents.

Regardless of cause, traffic congestion is often exacerbated due to drivers slowing down to observe vehicles on the side of the roadway. This "gawking" or "rubber-necking" typically occurs when drivers slow to observe car accidents, wreckage, and emergency response vehicles. Such gawking often magnifies traffic congestion.

Besides merely extending driving times and inducing driver frustration, increased congestion due to gawking also creates costs related to non-productivity. Such delays are often responsible for lost business, job-related disciplinary action, and other personal losses. Inability to forecast travel times causes drivers to allocate more time to travel, additionally resulting in productivity losses. Increased wear and tear to vehicles is yet another cost incurred by those caught in traffic. Finally, longer commutes due to gawking harm the environment due to increased air pollution and carbon dioxide emissions.

While gawking continues to be a significant contributor to traffic congestion, very little has been done to alleviate this problem.

SUMMARY

In view of the foregoing background, it is therefore an object of the present invention to provide a portable traffic vision screen to prevent or reduce traffic gawking, thereby reducing a primary cause of vehicular traffic congestion. Such a screen should be adjustable, scalable, and wind-resistant. Moreover, such screen should be free-standing.

The invention contemplates a wind-resistant portable traffic screen comprising a screen for the purpose of visually occluding one's view of matter behind the screen. A substantially vertical member holds the screen, and a fastener with the screen removably attaches the screen to the vertical member. The screen partially disengages from the vertical member upon exposure to a sufficient wind current. The purpose the disengaging screen is to reduce wind pressure exerted upon the screen and the vertical member. The screen re-engages the vertical member when the pressure from the wind current wanes.

In one embodiment of the portable traffic screen, a first and second support tube each have a top and bottom end. First and second inner retractable support tube extensions extend out of the top end of the first support tube and the second support tube, respectively. A retractable tripod assembly attaches to the bottom end of each support tube, and is situated to maintain the support tubes in a substantially vertical and free-standing orientation when the tripod assembly is in an expanded state. Ballast in communication with the tripod provides stability to the tripod assembly. The foldable screen has an upper edge, opposing lower edge, a side edge, and an opposing side edge, wherein the screen is attachable substantially between the support tubes.

Additionally, a magnet is in communication with each side edge of the screen, the magnet placed for removably attaching each side edge to a proximate support tube. The magnet is capable of partially disengaging the screen from the support tubes to relieve pressure exerted by a wind current.

The portable traffic screen further comprises a second foldable screen having a second upper edge, second opposing lower edge, second side edge, and a second opposing side edge, wherein the second screen is attachable substantially between the support tubes. A second magnet is in communication with each second side edge of the second screen, the second magnet placed for removably attaching each second side edge to a proximate support tube. The second magnet is capable of partially disengaging the second screen from the support tubes to relieve pressure exerted by a wind current.

In yet another embodiment, a portable traffic screen comprises a first and second extendable support tube. Each tube has a top and bottom end and each tube has a ferrous region. A hub is attached to each support tube, each hub having a size and dimension to engage a crossmember. A retractable tripod assembly is attached to the bottom end of each support tube, and the tripod assembly is situated for maintaining the support tubes in a substantially vertical, free-standing, orientation when the tripod assembly is in an expanded state. A foldable screen is attachable between the support tubes. Additionally, a substantially rigid crossmember attaches proximate a top edge of the screen, the crossmember being attachable to each hub.

A magnet is attached to a peripheral region of the screen, the magnet being positioned for removably attaching the peripheral region to the ferrous region of a proximate support tube. The magnet is capable of temporarily disengaging the screen from the support tubes to relieve pressure exerted upon the screen being created by a wind current. A cable attached between the screen and a support tube is present for limiting a distance the screen travels when the screen is temporarily disengaged from the support tube due to a wind current.

The invention also contemplates a method of assembling the traffic screen comprising the steps of expanding the tripod assembly of each support tube; standing each support tube in a substantially vertical orientation; extending each support tube; attaching the crossmember to the hub of each support tube; and attaching the cable to at least one support tube.

The method of assembling the traffic screen may also comprise the step of attaching a ballast proximate at least one tripod assembly and/or the step of adjusting the length of the cable.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

In the Summary of the Invention above and in the Detailed Description of the Invention and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other ingredients, ingredients, steps, etc. are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

In this section, the present invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

Figure 1:
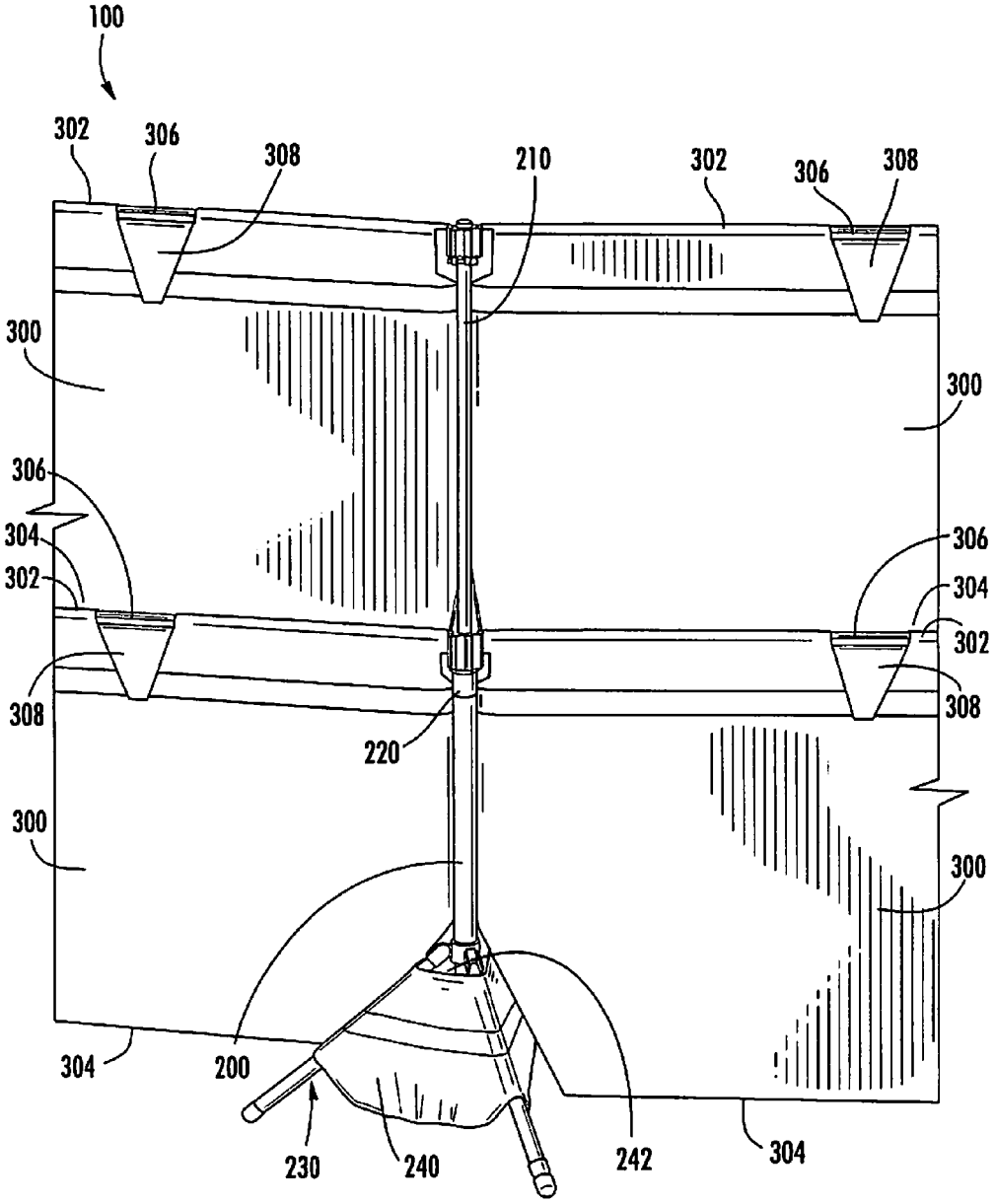
FIG. 1 illustrates a perspective view of the assembly.

FIG. 1 illustrates the portable traffic screen assembly 100. The assembly 100 is a wind-resistant portable screen that is free-standing, and easily deployed on the side of a road in order to visually block matter behind the assembly 100. The assembly 100 comprises support tubes 200 which are vertical members that provide support to other structures of the assembly 100. Supported by the support tubes 200 is at least one screen 300 that is used to visually block matter, such as an accident, from the view of nearby onlookers. The onlookers are typically vehicle drivers, vehicle passengers, bike riders, and pedestrians.

Support Tubes

With continuing reference to FIG. 1, the support tubes 200 are members intended to be deployed in a substantially vertical orientation. The support tubes are preferably hollow to save weight, and also made of a lightweight material. In a preferred embodiment, the support tubes 200 are made of aluminum, but other materials such as metals, plastics, and composite materials are also contemplated. In a preferred embodiment, the support tubes 200 comprise an extendable/retractable inner support tube 210. The inner support tube 210 is a size and dimension to nest within the support tube 200 and slidigly engage an inner surface of the support tube 200. A lock collar 220 on the support tube 200 provides the mechanism to maintain the inner support tube 210 in an extended position. A user adjusts the lock collar 220 between a locked and unlocked state, so that when the lock collar is in an unlocked state, the inner support tube 210 slides freely within the support tube 200.

Figure 2:
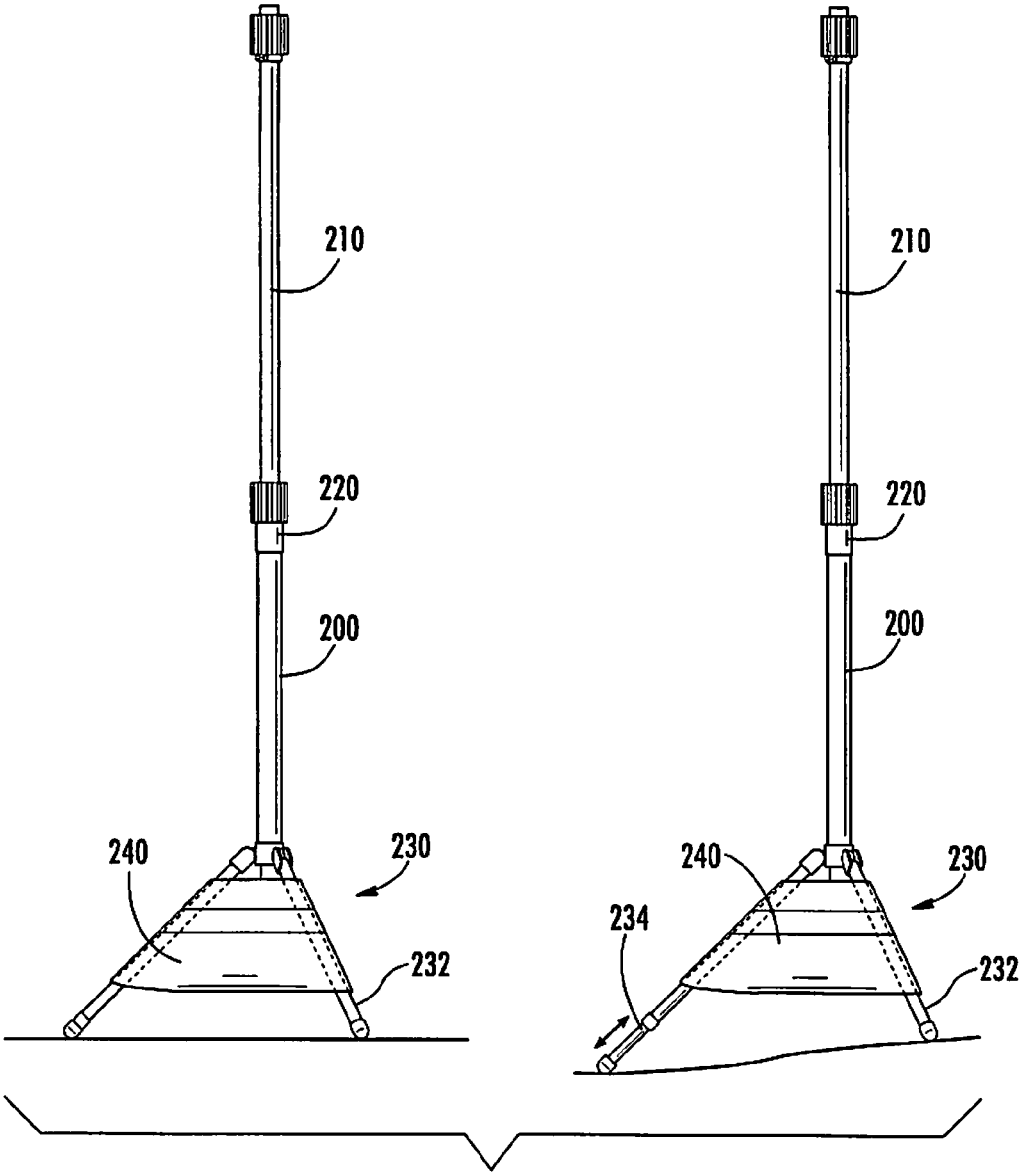
FIG. 2 illustrates side views of the assembly of FIG. 1 having an adjustable tripod.
Figure 3:
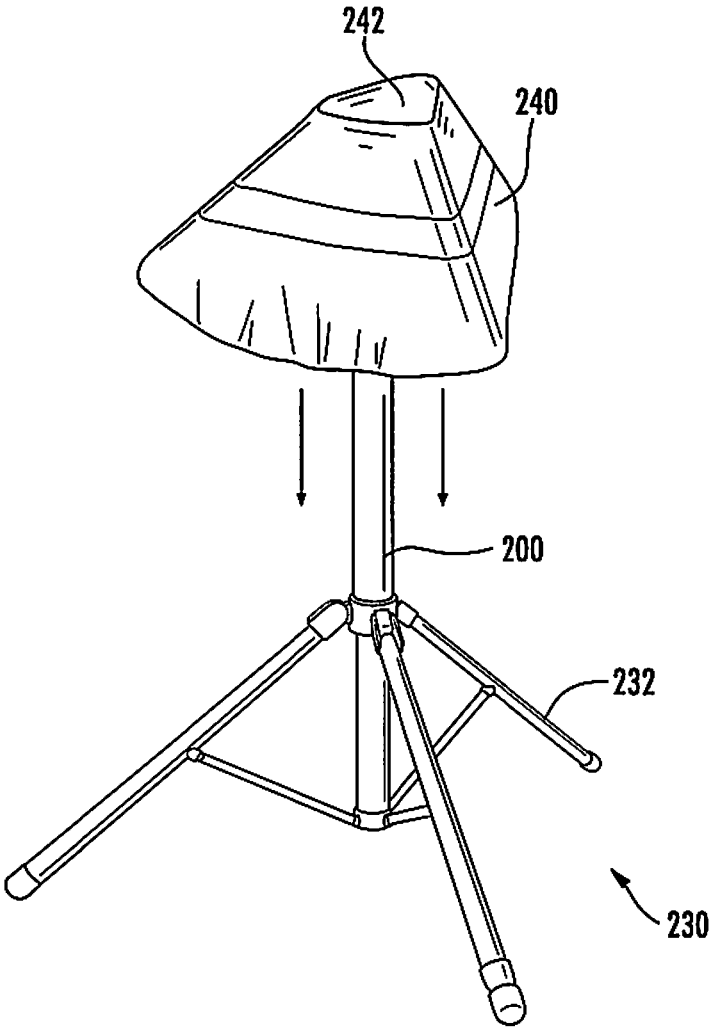
FIG. 3 illustrates a perspective view of a weight skirt of the assembly in FIG. 1.

With reference to FIGS. 1-3, a tripod 230 is attached to the base of the support tube 200. The tripod comprises at least three legs 232. The tripod 230 is adjustable so that the legs 232 fold to be approximately parallel to the support tube 200 for storage and transportation.

FIG. 2 illustrates one embodiment of the present invention that includes a tripod comprising a telescoping leg 234. When the support tube 200 is arranged to be self-standing on flat ground, the legs 232, 234 of the tripod 230 are substantially the same length. However, if the support tube 200 is arranged to be self-standing on uneven ground, the telescoping leg 234 of the tripod 230 is adjusted so that the support tube maintains an orientation that is substantially plumb.

As shown in FIG. 2, and now also referring to FIG. 3, a weight skirt 240 is placed over the legs 232, 234 of the tripod 230 to add stability-providing ballast to the assembly 100. In one embodiment, the weight skirt 240 comprises at least one panel configured to form a substantially pyramidal cover that rests upon the legs 232, 234. A hole 242 is defined by the configuration that allows the skirt 240 to fit over the support tube 200, with the tube 200 projecting through the hole 242. At least one weight is attached to the weight skirt 240 to provide mass to the skirt 240 for ballast. The weight skirt 240 is preferably substantially flexible so that it is easily folded for storage and transportation purposes. For use, the weight skirt is placed over the support tube 200 so that the tube 200 projects through the hole 242, and the skirt 240 is further lowered and allowed to rest upon the tripod 230.

Screen

FIG. 1 also illustrates the screen 300. The screen is made from natural or synthetic materials. For example, without limitation, the screen 300 can be made from at least one of plastic, nylon, aramid, acrylic, PTFE, fluoropolymer, spandex, olefin, Ingeo, carbon, cotton, hemp, and bamboo. In a preferred embodiment, the screen 300 is made from a durable water repellent material.

Figure 4:
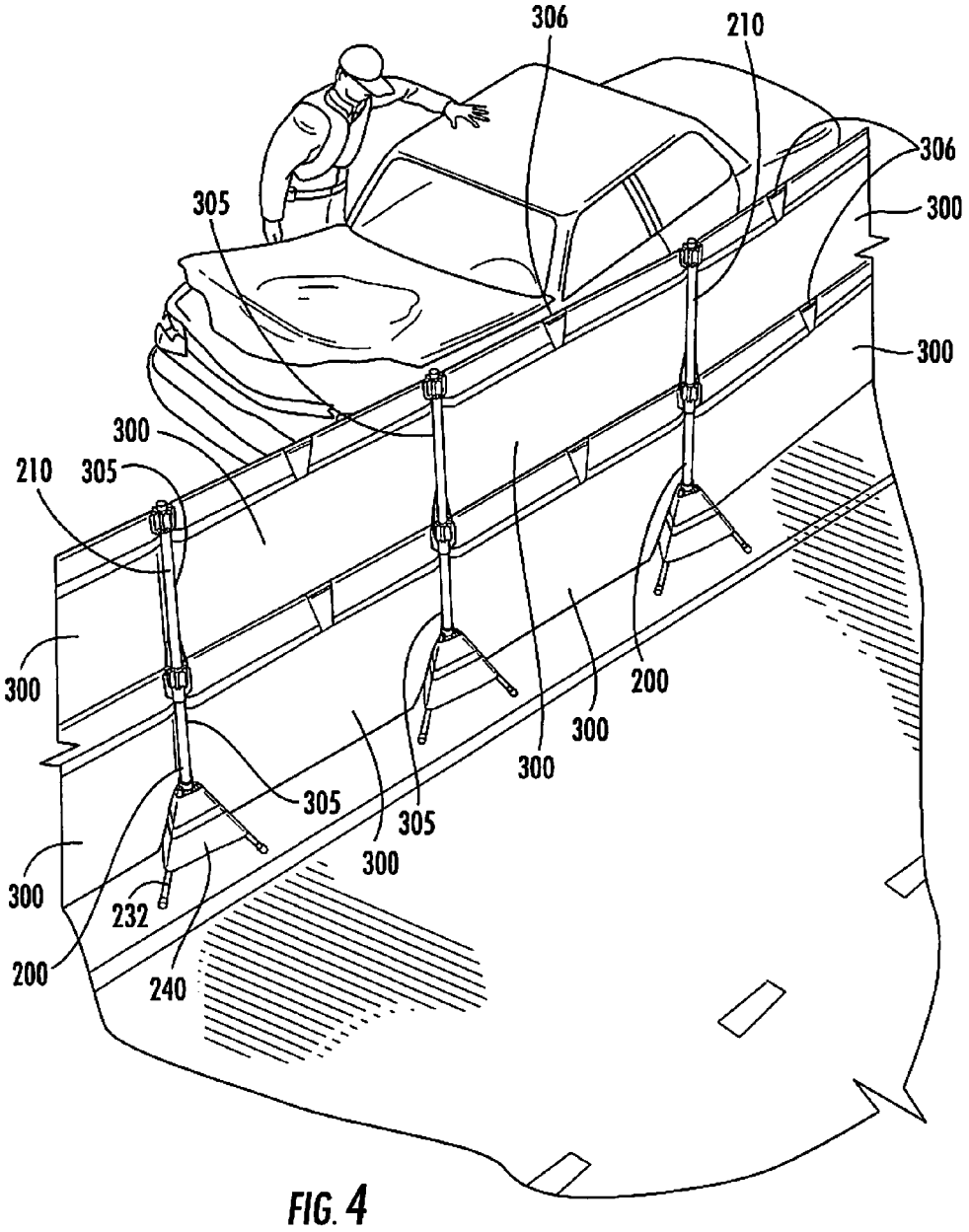
FIG. 4 illustrates a perspective view of the assembly of FIG. 1 in a used condition.

With continuing reference to FIG. 1, and turning also to FIG. 4, each screen 300 has an upper edge 302, and opposing lower edge 304, and opposing side edges 305. As illustrated, each support tube 200 supports a plurality of screens 300.

A screen 300 comprises a rigid crossmember 306 that is attachable between support tubes 200. In one embodiment, the screen 300 is configured to create a void wherein the crossmember 306 fits. The screen also defines a cutout 308 to allow exposure of the crossmember 306 for ease of handling and access to the crossmember 306. The crossmember 306 is made of a substantially rigid material such as metal, polymer, plastic, or composite.

Figure 5:
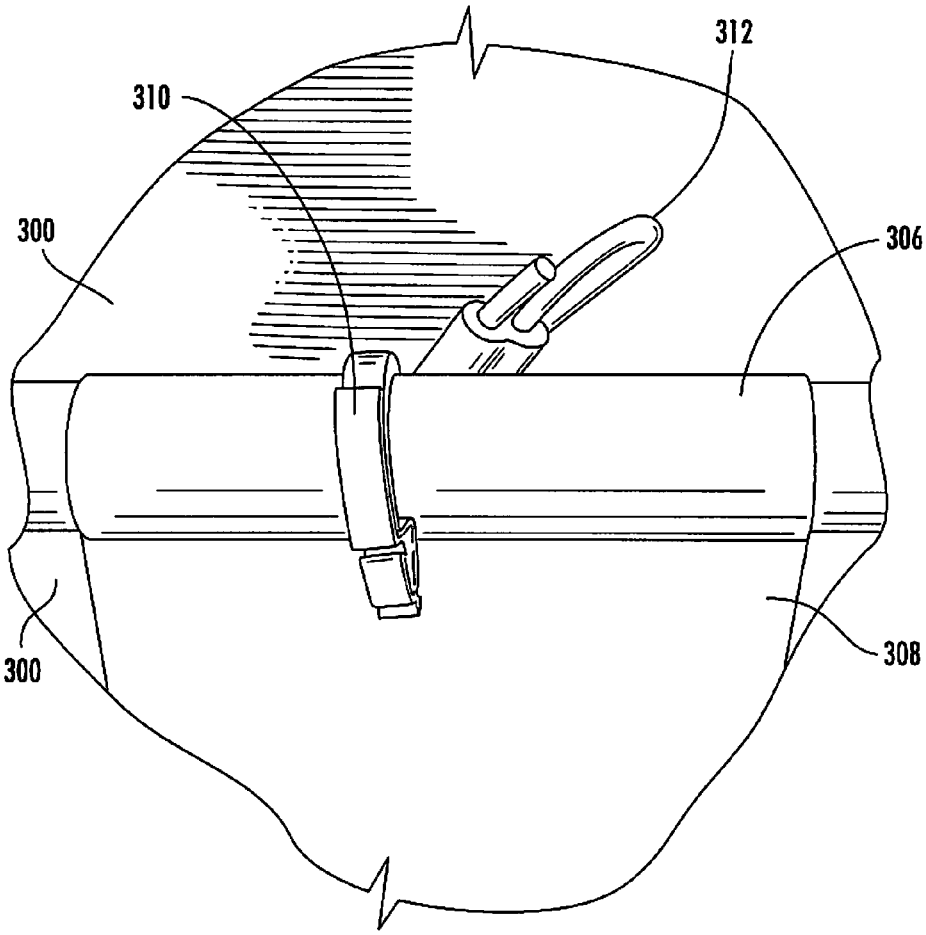
FIG. 5 illustrates a perspective view of a clip of the assembly.

FIG. 5 illustrates a center clip 310 that attaches to the crossmember 306 of a (upper) screen 300 positioned below a like (lower) screen 300. The clip 310 is attached to a center cable 312. The center cable 312 is also attached to the (upper) screen 300 positioned above the like (lower) screen 300. The length of the center cable 312 is adjustable, allowing the lower edge 304 of the (upper) screen 300 to move away from the crossmember 306 of the (lower) screen 300 an amount constrained by the length for which the center cable 312 is adjusted.

Figure 6:
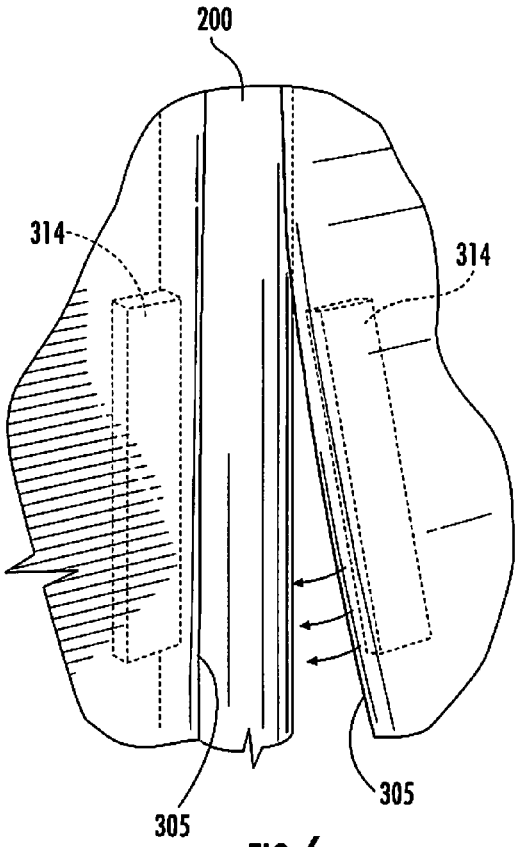
FIG. 6 illustrates a perspective magnets embedded in a screen of the assembly shown in FIG. 1.

FIG. 6 illustrates a magnet 314 that is located with the screen 300. Preferably, at least one magnet 314 is located proximate the side edge 305. The magnet 314 is either attached to the outside of the screen 300 or installed inside the screen 300. The support tube 200 comprises a ferrous region that engages the screen 300 and magnet 314. In an alternative embodiment, the magnet 314 is a ferrous material, and the ferrous region of the support tube 200 is magnetic. The purpose of the magnet 314 is to hold the screen 300 attached to the support tube 200. In another embodiment, both the support tube 200 and screen 300 comprise attracting magnetic regions.

Figure 7:
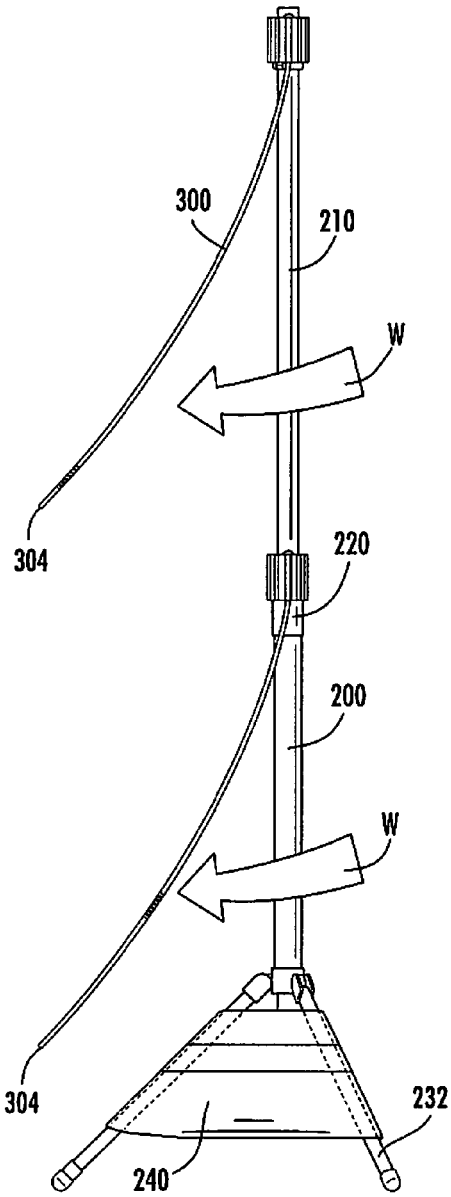
FIG. 7 illustrates a side view of the assembly illustrated in FIG. 1 exposed to wind.

As illustrated in FIG. 7, in the case of exposure of the assembly 100 to wind (W), the wind (W) exerts a pressure on the assembly 100, risking toppling the assembly 100 over. The magnets 314 attach the screen 300 to the support tube, but when the pressure upon the screen 300 exerted by the wind (W) exceeds that required to keep the magnets 314 (and therefore screen 300) engaged to the support tube 200, the screen 300 releases from the support tube 200 relieving the wind pressure on the assembly 100. In this case, when the wind pressure lessens, the screen 300 side edge 305 returns nearer the support tube 200 and the magnets 314 reattach to the support tube 200.

In an alternative embodiment, a hook and loop fastener is used to releasably attach the screen 300 to the support tube 200. Hook and loop fastener may be used alone, or in conjunction with the magnets 314.

Figure 8:
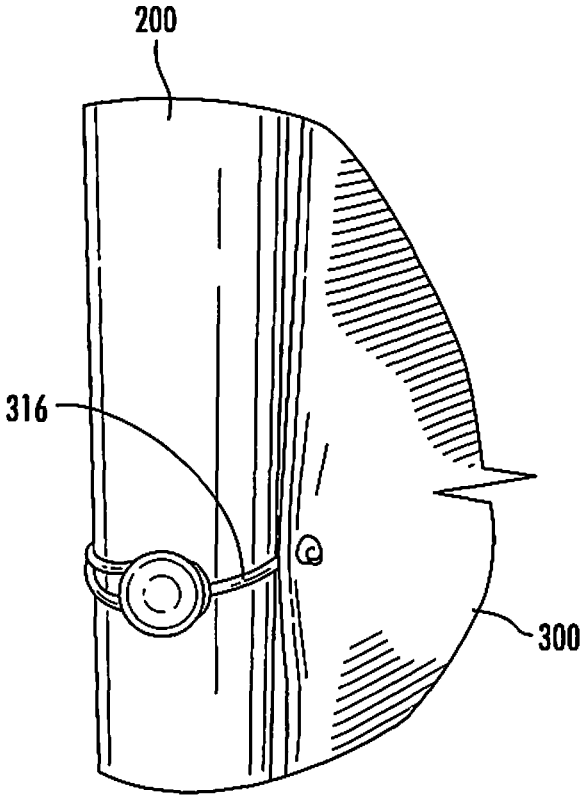
FIG. 8 illustrates a cable of the assembly illustrated in FIG. 1.

As illustrated by FIG. 8, one embodiment of the assembly 100 comprises a cabled fastener 316 attached to the support tube 200 and also proximate the side edge 305 of the screen 300 to limit the distance the screen 300 travels when pressure upon the screen 300 is exerted by the wind (W). The cabled fastener 316 comprises a static or elastic cable such as rope or elastic bands. In the embodiment illustrated in FIG. 8, the cabled fastener 316 is a bungee ball tie.

Figure 9:
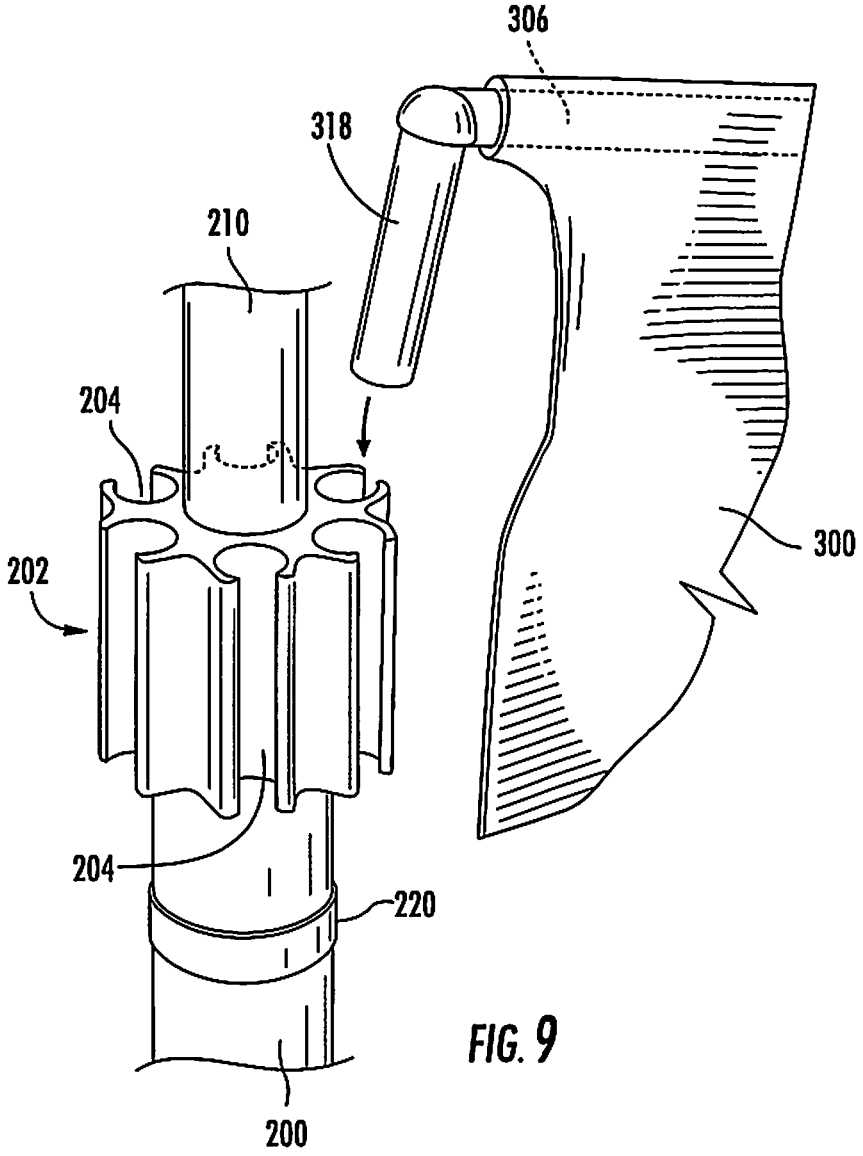
FIG. 9 illustrates a hub for attaching a screen to a vertical member of the assembly illustrated in FIG. 1.

As illustrated in FIG. 4, the crossmember 306 spans between, and attaches to, adjacent support tubes 200. FIG. 9 illustrates a hub 202 that is attached to a support tube 200 for engaging the crossmember 306. The hub 202 encircles the support tube 200 and comprises a plurality of slots 204. Each support tube 200 has at least one hub 202, and preferably has a hub situated proximate the middle of the support tube 200 and another situated proximate the top of the support tube 200. Additionally, each crossmember 306 comprises a swivel pin 318. The swivel pins are of a size and dimension to securely mate to the slots 204, providing an attachment point between the crossmembers 306 and support tubes 200. The slots 204 are arranged radially about the support tube 200 so that multiple assembly 100 configurations are possible. FIG. 4 illustrates a configuration wherein screens 300 are arranged in a substantially linear fashion with respect to each other.

Method

The invention contemplates a method of assembling the traffic screen assembly 100 described herein. In particular, the steps included in the method are expanding the tripod 230 of each support tube 200 so that the support tube has a base on which it can stand. This is followed by standing each support tube 200 in a substantially vertical orientation. In embodiments of the invention with an extendable support tube 200, the support tubes 200 are extended. To mount the screens 300, crossmembers 306 are attached to the hub 202 of each support tube 200, and each cable 316 is attached to a proximate support tube 200. The length of the cable 316 is adjusted based on wind conditions. Additionally, ballast typically in the form of a weight skirt 240 is attached proximate at least one tripod 230.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A portable traffic screen assembly comprising:

a pair of vertical support members, each of the pair of vertical support members extending between a support member upper end and a support member lower end;

a pair of support member bases, each of the pair of support member bases being attached to a respective one of the support member lower ends;

a first rigid crossmember releasably connected between the support member upper ends;

a first screen extending between first screen opposite sides, a first screen upper edge and a first screen lower edge, each of the first screen opposite sides being adjacent to a respective one of the pair of vertical support members, a first screen void being defined along the first screen upper edge in which the first rigid crossmember is received;

at least two first screen coupling mechanisms, each releasably coupling a respective one of the first screen opposite sides to its respective vertical support members, the at least two first screen coupling members allowing the first screen opposite sides to decouple from their respective vertical support members, such that the first screen is outwardly rotatable about the first rigid crossmember under wind pressure; and a pair of first crossmember attachment hubs, each of the pair of first crossmember hubs extending around a respective one of the vertical support members and defining a plurality of downwardly extending slots therein;

wherein each end of the first rigid crossmember has a first crossmember pin extending downwardly therefrom, each of the first crossmember pins being received in one of the plurality of downwardly extending on slots on a respective one of the first crossmember hubs.

2. The assembly of claim 1, wherein the first screen is made of foldable material.

3. The assembly of claim 1, wherein the at least two first screen coupling mechanisms include magnets.

4. The assembly of claim 1, wherein the first screen defines a first screen cutout communicating with the first screen void to allow access to the first rigid crossmember.

5. The assembly of claim 4, wherein the first screen cutout is centrally located between the pair of vertical support members.

6. The assembly of claim 1, wherein each of the pair of support member bases includes a collapsible tripod.

7. The assembly of claim 6, wherein at least one leg of each of the collapsible tripods is adjustable in length.

8. The assembly of claim 6, further comprising a pair of weighted skirts, each of the weighted skirts being arranged over a respective one of the collapsible tripods.

9. The assembly of claim 1, further comprising:

a second rigid crossmember releasably connected below the support member upper ends;

a second screen extending between second screen opposite sides, a second screen upper edge and a second screen lower edge, each of the second screen opposite sides being adjacent to a respective one of the pair of vertical support members, a second screen void being defined along the second screen upper edge in which the second rigid crossmember is received; and at least two second screen coupling mechanisms, each releasably coupling a respective one of the second screen opposite sides to its respective vertical support members, the at least two second screen coupling members allowing the second screen opposite sides to decouple from their respective vertical support members, such that the second screen is outwardly rotatable about the second rigid crossmember under wind pressure.

10. The assembly of claim 9, wherein the second rigid crossmember extends adjacent to the first screen lower edge.

11. The assembly of claim 10, further comprising a cable connected between the second rigid crossmember and the first screen lower edge, the cable limiting outward rotation of the first screen under wind pressure.

12. The assembly of claim 9, wherein each of the pair of vertical support members includes first and second support tubes, the first rigid crossmember being connected between respective first support tube upper ends and the second rigid crossmember being connected between respective second support tube upper ends.

13. The assembly of claim 12, wherein each of the first support tubes is retractable into its respective second support tube.

14. A portable traffic screen assembly comprising:

a pair of vertical support members, each of the pair of vertical support members extending between a support member upper end and a support member lower end;

a pair of support member bases, each of the pair of support member bases being attached to a respective one of the support member lower ends;

a first rigid crossmember releasably connected between the support member upper ends;

a first screen extending between first screen opposite sides, a first screen upper edge and a first screen lower edge, each of the first screen opposite sides being adjacent to a respective one of the pair of vertical support members, the first screen upper edge being arranged on the first rigid crossmember;

at least two second screen coupling mechanisms, each releasably coupling a respective one of the second screen opposite sides to its respective vertical support members, the at least two second screen coupling members allowing the second screen opposite sides to decouple from their respective vertical support members, such that the second screen is outwardly rotatable about the second rigid crossmember under wind pressure;

a second rigid crossmember releasably connected between the vertical support members adjacent the first screen lower edge;

a second screen extending between second screen opposite sides, a second screen upper edge and a second screen lower edge, each of the second screen opposite sides being adjacent to a respective one of the pair of vertical support members, the second screen upper edge being arranged on the second rigid crossmember;

at least two second screen coupling mechanisms, each releasably coupling a respective one of the second screen opposite sides to its respective vertical support members, the at least two second screen coupling members allowing the second screen opposite sides to decouple from their respective vertical support members, such that the second screen is outwardly rotatable about the second rigid crossmember under wind pressure;

a pair of first crossmember attachment hubs, each of the pair of first crossmember hubs extending around a respective first support tube upper end and defining a plurality of first downwardly extending slots therein; and a pair of second crossmember attachment hubs, each of the pair of second crossmember hubs extending around a respective second support tube upper end and defining a plurality of second downwardly extending slots therein;

wherein each of the pair of vertical support members includes first and second support tubes, the first rigid crossmember being connected between respective first support tube upper ends and the second rigid crossmember being connected between respective second support tube upper ends;

wherein each of the first support tubes is retractable into its respective second support tube;

wherein each end of the first rigid crossmember has a first crossmember pin extending downwardly therefrom, each of the first crossmember pins being received in one of the plurality of first downwardly extending on slots on a respective one of the first crossmember hubs; and wherein each end of the second rigid crossmember has a second crossmember pin extending downwardly therefrom, each of the second crossmember pins being received in one of the plurality of second downwardly extending on slots on a respective one of the second crossmember hubs.

15. The assembly of claim 14, further comprising a cable connected between the second rigid crossmember and the first screen lower edge, the cable limiting outward rotation of the first screen under wind pressure.

16. The assembly of claim 14, wherein the first and second screens define respective first and second voids along the respective first and second screen upper edges, the first and second crossmembers being received in the first and second voids, respectively.

* * * * *